US008829376B2

(12) United States Patent
Wei

(10) Patent No.: US 8,829,376 B2
(45) Date of Patent: Sep. 9, 2014

(54) CONTROL PANEL FOR FITNESS EQUIPMENT

(75) Inventor: Tsao-Kuang Wei, Taichung (TW)

(73) Assignee: Paradigm Inc., Taichung (TW)

( * ) Notice: Subject to any disclaimer, the term of this patent is extended or adjusted under 35 U.S.C. 154(b) by 168 days.

(21) Appl. No.: 13/547,158

(22) Filed: Jul. 12, 2012

(65) Prior Publication Data

US 2014/0014484 A1 Jan. 16, 2014

(51) Int. Cl.
*H01H 3/08* (2006.01)
*H01H 19/00* (2006.01)

(52) U.S. Cl.
USPC ..... 200/336; 200/296

(58) Field of Classification Search
CPC ..... H01H 3/08; H01H 9/02; H01H 19/04; H01H 19/08; H01H 19/14; H01H 2019/14; H01H 2231/016; A63B 22/04; A63B 22/0056; A63B 22/02; A63B 22/0235; A63B 22/0257; A63B 24/00
USPC ..... 200/336, 179, 564, 565, 567, 293, 296
See application file for complete search history.

(56) References Cited

U.S. PATENT DOCUMENTS

| | | | | |
|---|---|---|---|---|
| 7,038,156 | B2 * | 5/2006 | Kim et al. | 200/564 |
| 7,041,922 | B2 * | 5/2006 | Geiger et al. | 200/296 |
| 7,179,202 | B2 * | 2/2007 | Marin et al. | 482/54 |
| 7,202,433 | B2 * | 4/2007 | Howie | 200/565 |
| 2003/0022765 | A1 * | 1/2003 | Wu | 482/92 |
| 2004/0214693 | A1 * | 10/2004 | Piaget et al. | 482/52 |
| 2008/0119337 | A1 * | 5/2008 | Wilkins et al. | 482/130 |
| 2010/0006411 | A1 * | 1/2010 | Iordache | 200/296 |

* cited by examiner

*Primary Examiner* — Kyung Lee
(74) *Attorney, Agent, or Firm* — Rahman LLC

(57) ABSTRACT

A control panel for fitness equipment has a board, a screen, a rotary knob switch and a wire. The board has an inner surface and an outer surface. The screen is securely mounted on the outer surface of the board. The rotary knob switch is rotatably mounted through the board beside the screen and has a held end and a wire end opposite to the held end. The wire has an end that is securely mounted at the wire end of the rotary knob switch. Accordingly, the rotary knob switch can be directly and conveniently turned at the board.

2 Claims, 6 Drawing Sheets

CONTROL PANEL FOR FITNESS EQUIPMENT

BACKGROUND OF THE INVENTION

1. Field of the Invention

The present invention relates to a control panel for fitness equipment, and more particularly to a control panel having a rotary knob switch.

2. Description of Related Art

A conventional fitness equipment, such as a treadmill, a gym bike or an elliptical trainer, usually has a rotary knob switch used to adjust resistance of the fitness equipment. When the conventional rotary knob switch is turned, the rotary knob switch pulls a wire and the wire pulls a magnet device. Consequently, the magnet device is pivoted upward and approaches a wheel. With the change of magnet force between the wheel and the magnet device, the resistance of the fitness equipment can be adjusted.

However, the conventional rotary knob switch is located below a user or located at a side surface of the fitness equipment. For example, the conventional rotary knob switch is mounted on a treadmill base at a position below the user, or is mounted on a seat post of a gym bike at a position below a seat of the gym bike.

Because the conventional rotary knob switch is located a lower position on the fitness equipment, the user has to bend down to turn the rotary knob switch during exercise, and this is dangerous, especially for the elderly. Otherwise, the user has to turn off the fitness equipment before turning the conventional rotary knob switch, and this is inconvenient in use.

To overcome the shortcomings, the present invention tends to provide a control panel for fitness equipment to mitigate the aforementioned problems.

SUMMARY OF THE INVENTION

The main objective of the invention is to provide a control panel for fitness equipment that has a rotary knob switch.

A control panel for fitness equipment has a board, a screen, a rotary knob switch and a wire. The board has an inner surface and an outer surface. The screen is securely mounted on the outer surface of the board. The rotary knob switch is rotatably mounted through the board beside the screen and has a held end and a wire end opposite to the held end. The wire has an end that is securely mounted at the wire end of the rotary knob switch. Accordingly, the rotary knob switch can be directly and conveniently turned at the board.

Other objects, advantages and novel features of the invention will become more apparent from the following detailed description when taken in conjunction with the accompanying drawings.

DETAILED DESCRIPTION OF PREFERRED EMBODIMENTS

Figure 1:
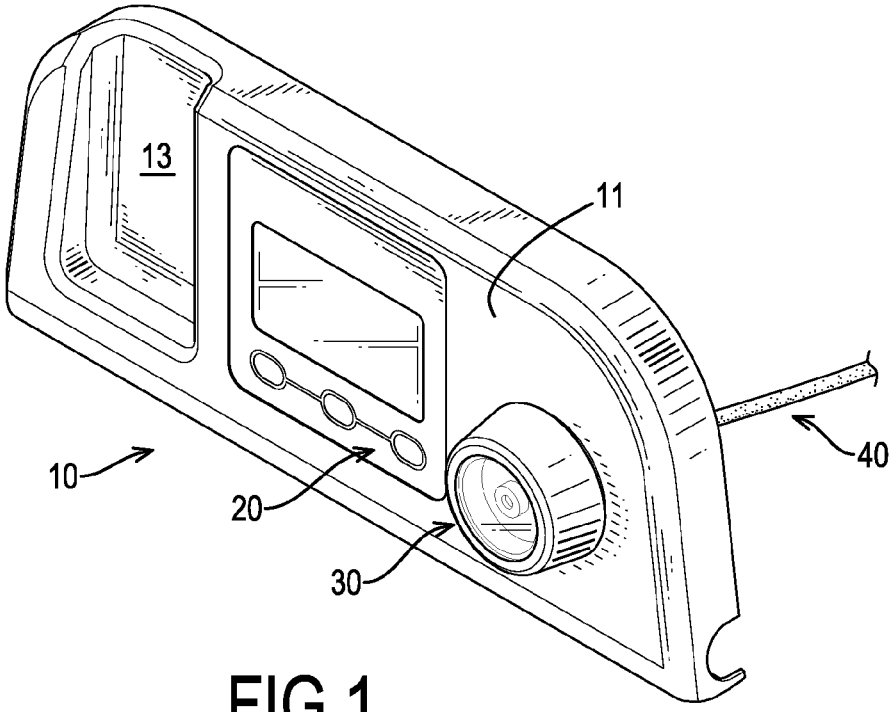
FIG. 1 is a perspective front view of a control panel for fitness equipment in accordance with the present invention.
Figure 2:
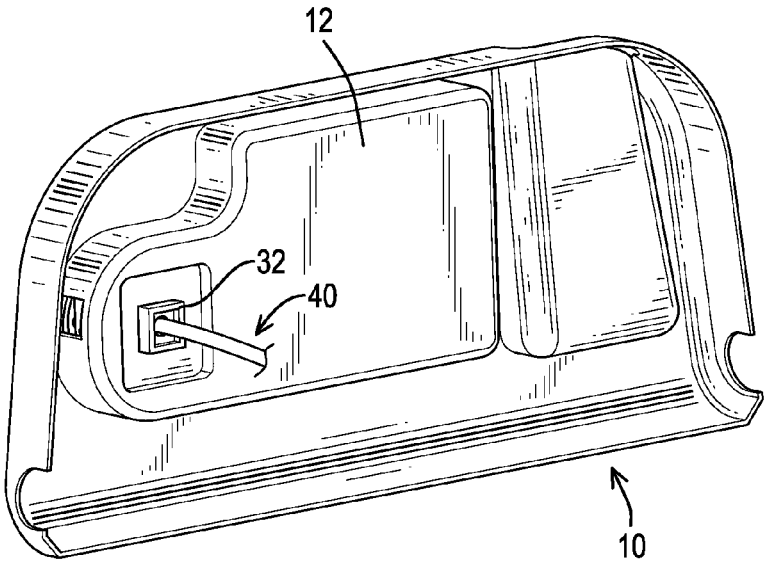
FIG. 2 is a rear perspective view of the control panel in FIG. 1.
Figure 3:
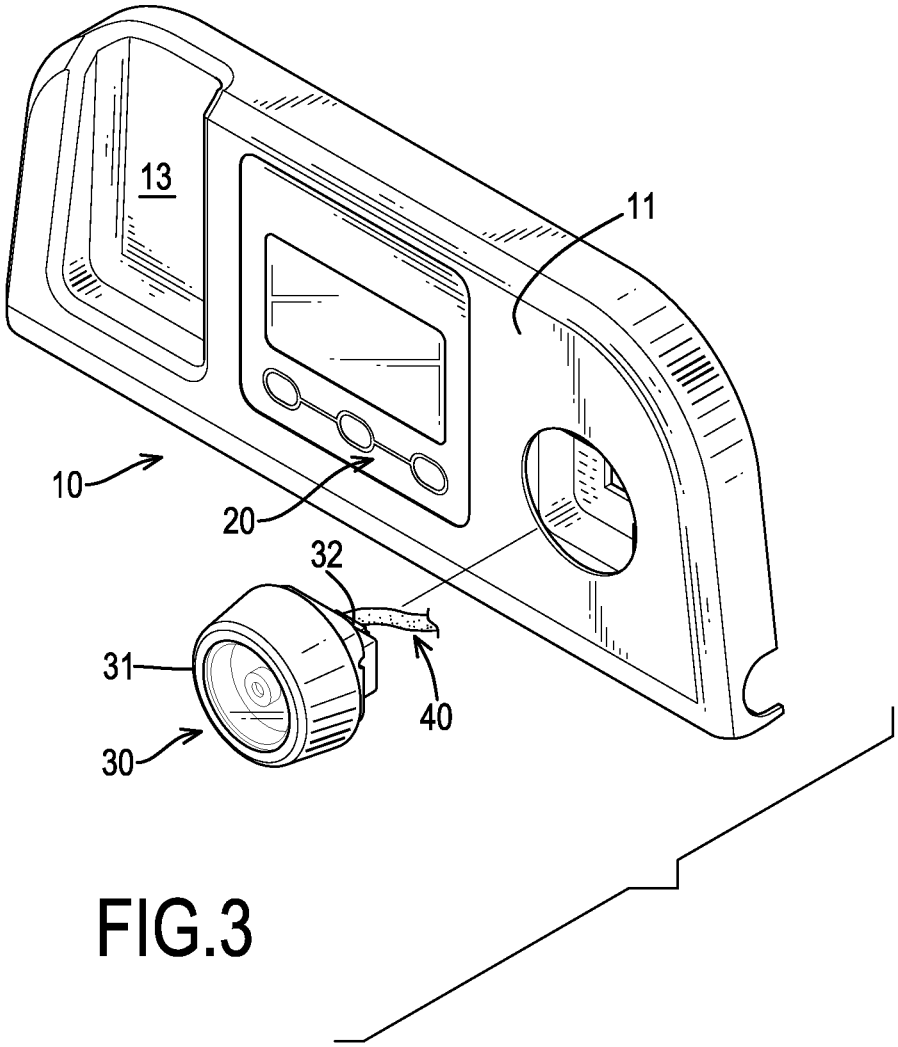
FIG. 3 is an exploded perspective view of the control panel in FIG. 1.
Figure 4:
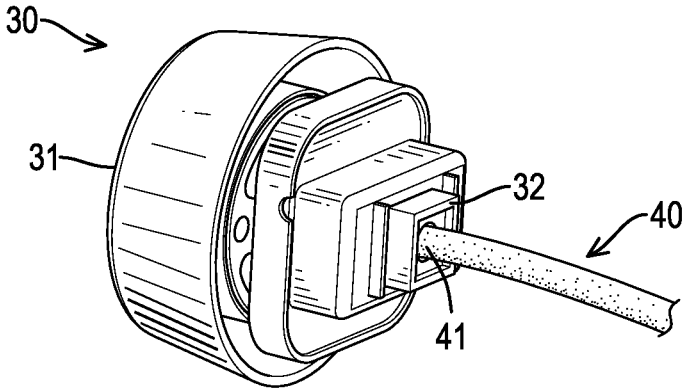
FIG. 4 is an enlarged perspective view of the rotary knob switch of the control panel in FIG. 1.

With reference to FIGS. 1 to 4, a control panel for fitness equipment in accordance with the present invention comprises a board 10, a screen 20, a rotary knob switch 30 and a wire 40. The board 10 has an outer surface 11 and an inner surface 12. The inner surface 12 is opposite to the outer surface 11 of the board 10. Preferably, the board 10 has a receiving recess 13 formed in the outer surface 11 of the board 10. The receiving recess 13 is used to receive a mobile phone or a water bottle.

The screen 20 is securely mounted on the outer surface 11 of the board 10. The rotary knob switch 30 is rotatably mounted through the board 10 beside the screen 20 and the receiving recess 13. The rotary knob switch 30 has a held end 31 and a wire end 32. The held end 31 of the rotary knob switch 30 is adjacent to the outer surface 11 of the board 10. The wire end 32 is opposite to the held end 31 and is adjacent to the inner surface 12 of the board 10. The wire 40 is securely connected with the rotary knob switch 30 and has a first end 41 and a second end 42. The first end 41 is securely connected to the wire end 32 of the rotary knob switch 30.

Figure 5:
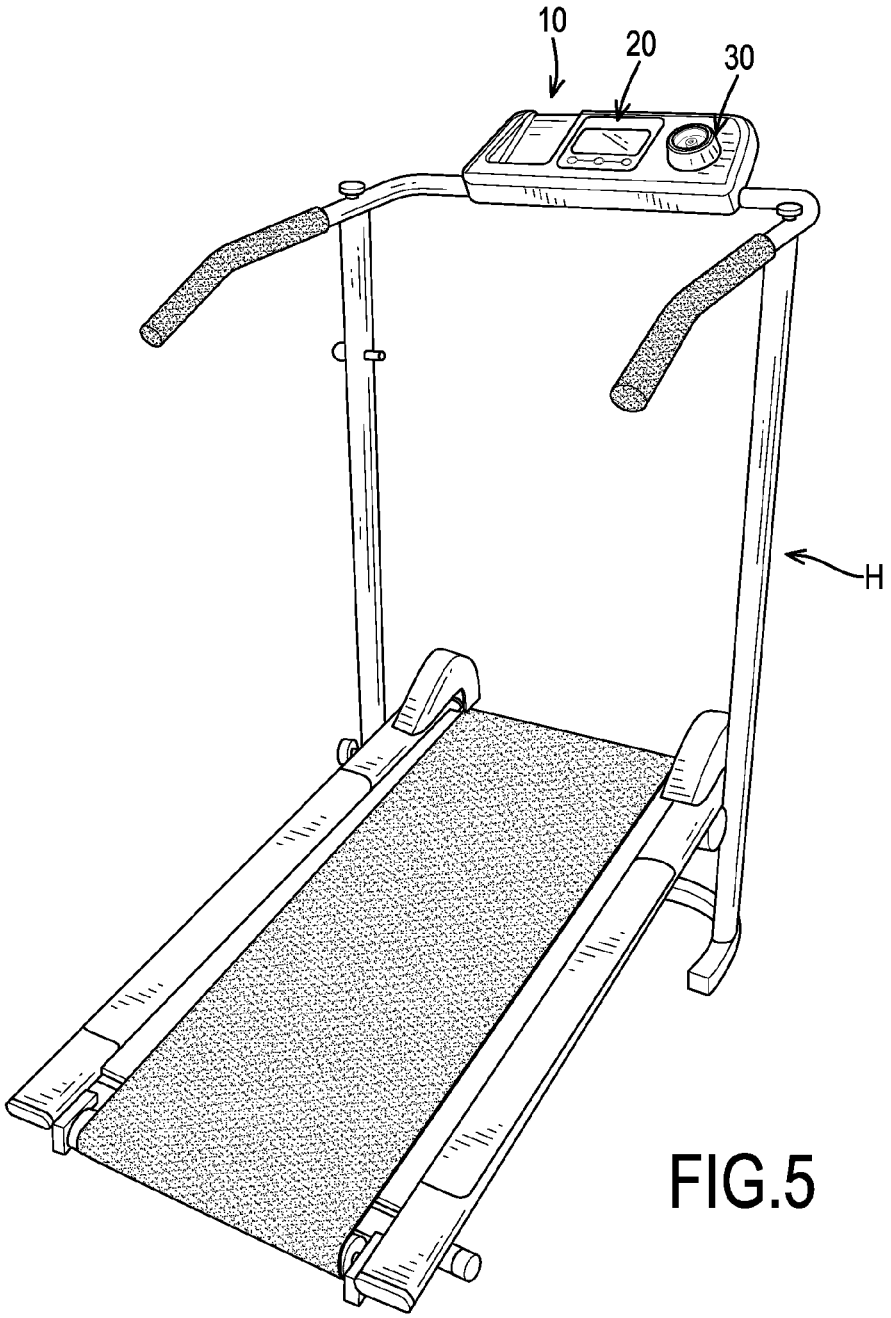
FIG. 5 is an operational perspective view of the control panel in FIG. 1 mounted on a top of a treadmill.

With reference to FIG. 5, the control panel in accordance with the present invention is securely mounted on a top of a treadmill H. Because the rotary knob switch 30 is in front of a user, the user can directly turn the rotary knob switch 30 with ease, and this is very convenient in use.

Figure 6:
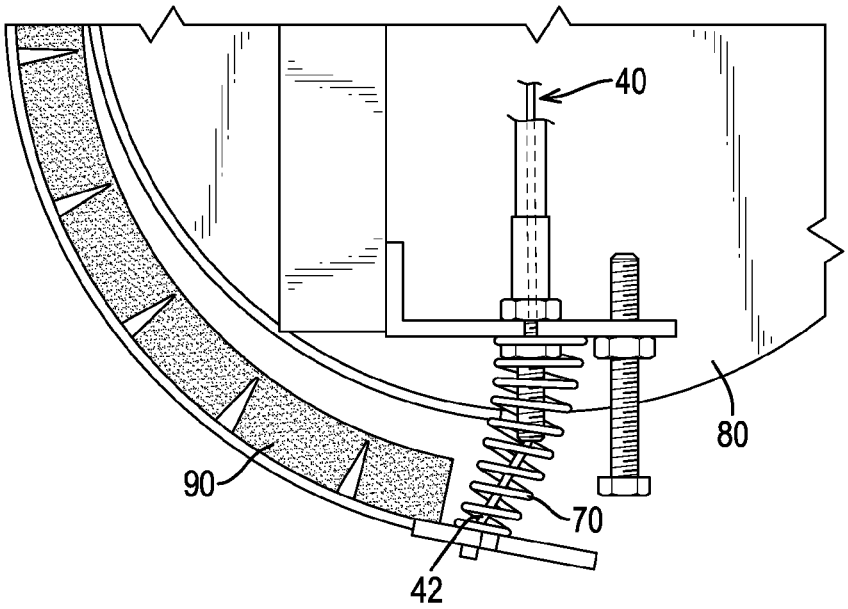
FIG. 6 is an enlarged operational side view of the control panel in FIG. 5 showing that the wire is connected with a magnet device.
Figure 7:
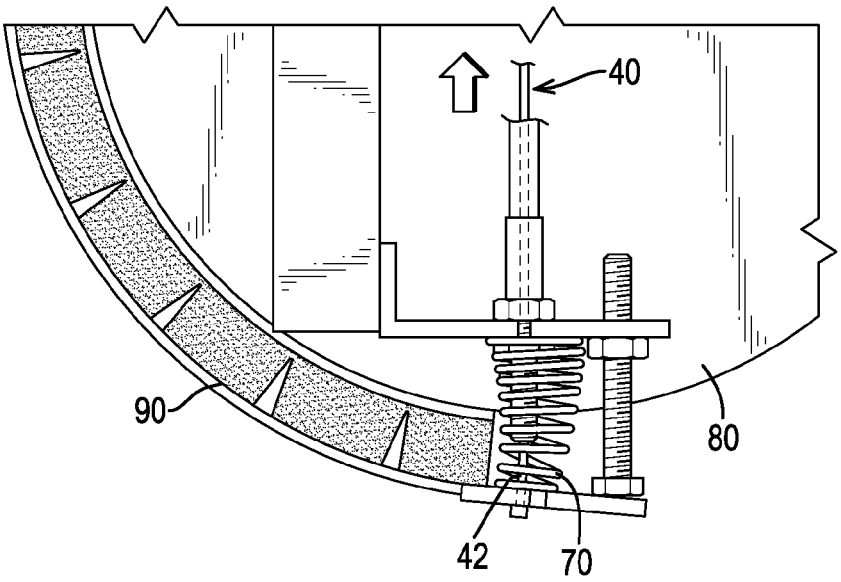
FIG. 7 is an enlarged operational side view of the control panel in FIG. 6 showing that the wire pulls the magnet device.

With reference to FIGS. 6 and 7, the rotary knob switch 30 is being turned to adjust resistance of the treadmill H. The second end 42 of the wire 40 is securely connected with a magnet device 90 of the treadmill H. A spring 70 is mounted around the second end 42 of the wire 40. When the rotary knob switch 30 is turned, the rotary knob switch 30 pulls the wire 40, the wire 40 pulls the magnet device 90, and the spring 70 is compressed. Consequently, the magnet device 90 is pivoted upward and approaches a wheel 80. With the change of magnet force between the wheel 80 and the magnet device 90, the resistance of the treadmill H can be adjusted.

In addition, the control panel can be mounted on any fitness equipment capable of adjusting resistance, such as a gym bike or an elliptical trainer. From the above description, it is noted that the present invention has the following advantage: Because the rotary knob switch 30 is located in front of a user, the user can directly and conveniently turn the rotary knob switch 30, instead of turning off fitness equipment or bending down to turn the conventional rotary knob switch.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A control panel for fitness equipment comprising:

a board comprising:

an inner surface; and an outer surface opposite to said inner surface of said board;

a screen securely mounted on said outer surface of said board;

a rotary knob switch rotatably mounted through said board beside said screen and comprising:

a held end adjacent to said outer surface of said board; and a wire end opposite to said held end and adjacent to said inner surface of said board;

a wire comprising:

a first end securely connected with said wire end of said rotary knob switch; and a second end oppositely positioned from said first end;

a spring mounted around said second end of said wire; and a magnet device connected to said second end of said wire.

2. The control panel of claim 1, wherein said board comprises a receiving recess formed in said outer surface of said board beside said screen and said rotary knob switch.

* * * * *